United States Patent [19]

Ackerman

[11] 4,260,216

[45] Apr. 7, 1981

[54] SPADE TERMINAL

[75] Inventor: Daniel W. Ackerman, Chenango Bridge, N.Y.

[73] Assignee: Universal Instruments Corporation, Binghamton, N.Y.

[21] Appl. No.: 66,361

[22] Filed: Aug. 14, 1979

Related U.S. Application Data

[63] Continuation-in-part of Ser. No. 904,657, May, 1978, abandoned.

[51] Int. Cl.[3] ..... H01R 9/12; H01R 9/16

[52] U.S. Cl. ..... 339/258 S; 339/220 R; 339/276 SF

[58] Field of Search ..... 339/256 SP, 258 S, 275 B, 339/276 SF, 220 R, 220 A, 220 C, 220 L, 220 T

[56] References Cited

U.S. PATENT DOCUMENTS 2,604,986 7/1952 Berg ..... 339/276 SF 3,910,671 10/1975 Townsend ..... 339/258 S

FOREIGN PATENT DOCUMENTS 2551970 8/1976 Fed. Rep. of Germany ..... 339/258 S 777677 6/1957 United Kingdom ..... 339/258 S

*Primary Examiner*—Neil Abrams

*Attorney, Agent, or Firm*—Fidelman, Wolffe & Waldron

[57] ABSTRACT

An improved spade terminal having two receptacles for use on a printed circuit board, slidingly receives the prongs of spade connectors between flat surfaces. A pair of tabs forming the base of the terminal are inserted into and extend through a hole in a printed circuit board. Each of the tabs is provided with raised abutting means which maintain separation of the tabs after insertion into a circuit board thus allowing automated mechanical clinching of the tabs to firmly hold the terminal on the board prior to soldering. A continuous strip of stamped and formed terminals feed an automatic insertion head.

2 Claims, 8 Drawing Figures

SPADE TERMINAL

CROSS-REFERENCE TO RELATED APPLICATIONS

This application is a continuation-in-part of application Ser. No. 904,657, filed May 10, 1978 and now abandoned.

BACKGROUND OF THE INVENTION

The present invention relates generally to electrical terminals for removable attachment thereto of conductive elements and more particularly to a terminal used with printed circuit boards for receiving and removably retaining conductors or other circuit elements terminated in spade connectors having male prongs.

Use of twin pronged spade connectors is old technology not only in electronics manufacturing but also in many non-electronic electrical wiring applications. Flat headed machine screws threaded into a non-conductive strip provided an intermediate holding position where many connectors were brought when permanent and direct connections of elements was undesirable or as a distribution point where one element is required to connect to a plurality of other elements. The spade connector is slipped beneath the screw head with prongs straddling the screw body; the prongs are held against the terminal strip when the screw is tightened. The screws are isolated electrically one from the other or are joined by conductive strips as needed for the associated circuit, all in the known manner. The terminal strip using screw tightening permits simple disconnection of any individual conductor without need to unsolder or otherwise modify the existing wiring. A disadvantage in prior art terminal strips is the need to loosen and tighten the screws in order to fasten or remove a connector.

With the increasing use of printed circuit boards, the need became apparent for terminals which can be automatically attached to the circuit board, and can receive and hold spade connectors without screw fastening. U.S. Pat. No. 3,910,671 discloses a spade connector terminal designed for use with printed circuit boards and automatic board assembly techniques. The terminal is capable of automatically or manually receiving and holding at least two spade connectors. However, the spade prong is retained under spring force acting in linear contact against the prongs, thereby creating a zone of concentrated stress which can limit the life of both the terminal and the connector when the connection is frequently made and unmade. Surface wear can cause both a loosened mechanical connection and a poor electrical connection when protective conductive coatings are abraded.

A pair of tabs forming the base of the terminal disclosed in U.S. Pat. No. 3,910,671 are spoon-shaped or concave in configuration to provide four points of contact when inserted in a hole in a printed circuit board. This configuration precludes clinching, and especially precludes automated mechanical clinching, of the terminal tabs to the board. An unclinched, friction-held terminal is susceptible to displacement during successive component insertion operations conventionally carried out prior to soldering and the use of such terminals introduces serious quality control problems into the manufacturing process.

SUMMARY OF THE INVENTION

The terminal of the instant invention provides in a single U-shaped element a pair of electrically connected receptacles for receiving the prongs of at least a pair of spade connectors. The connector prongs are inserted and removed from the receptacles by motion transverse to the plane of the circuit board thereby facilitating automatic assembly. Each prong when inserted in a receptacle is received slidingly and retained between two flat surfaces whereby localized friction wear is minimized and low resistance electrical contact is enhanced. Tabs on the terminal base are insertable through a pre-drilled hole in a printed circuit board, extend through the board and are maintained in a spaced-apart relationship to allow engagement with the arms of a clinching device which spreads the tabs into clinching engagement with the board.

Accordingly, it is an object of this invention to provide a spade terminal which is insertable in a circuit board by automatic means.

A further object of this invention is to provide a spade terminal which holds spade prongs between flat surfaces for good electrical contact and good wearing characteristics.

Still another object of the present invention is to provide a spade terminal adapted to be mechanically clinched to the circuit board by automatic means.

Other objects, advantages, and novel features of the present invention will become apparent from the following detailed description of the invention when considered in conjunction with the accompanying drawing in which.

Figure 1:
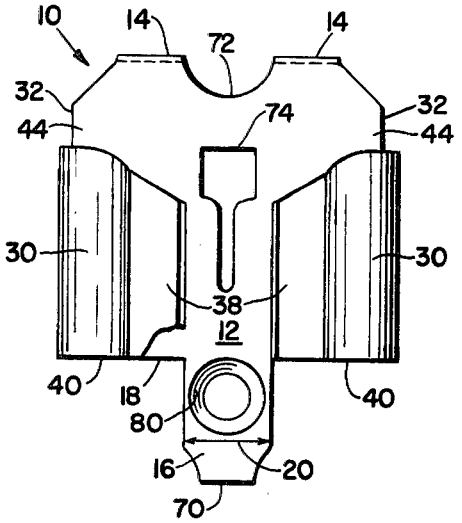
FIGS. 1 and 2 are a front elevational view and top view respectively to an enlarged scale of the spade terminal of this invention.
Figure 2:
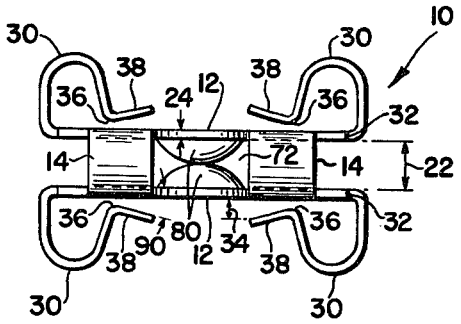
Figure 3:
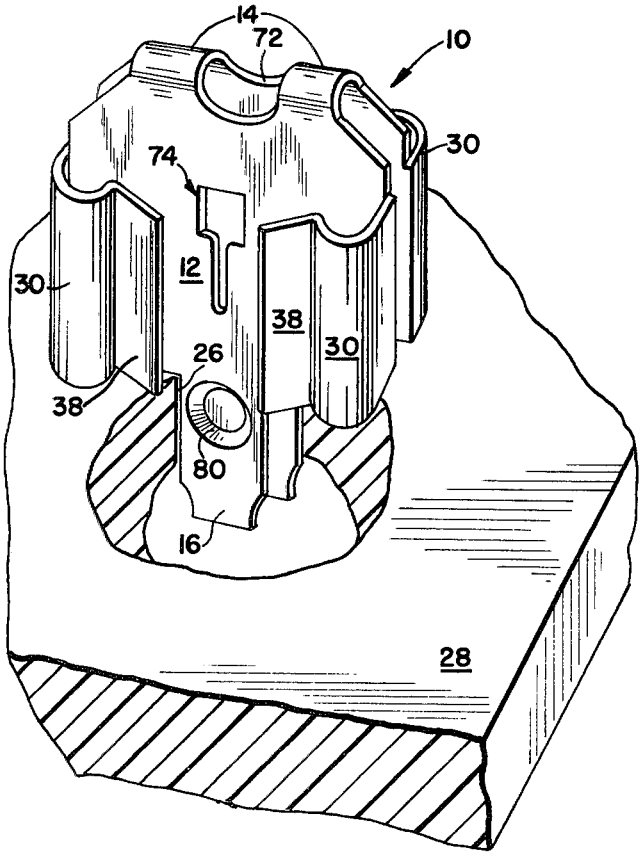
FIG. 3 is a perspective view of the spade terminal of FIG. 1 inserted in a hole in a circuit board.

Referring to the FIGS. 1–3, the spade terminal 10 of this invention is comprised of a pair of similar, generally parallel, planar, rectangular, facepieces 12 opposed one to the other and connected at the top edge (FIGS. 1, 2) by a pair of web elements 14, thereby providing a generally U-shaped terminal 10. A central tab 16 extends from the lower edge 18 (FIG. 1) of each facepiece 12, each tab 16 being coplanar with its respective facepiece 12. Abutting means 80 are provided on an upper portion of each tab adjacent the juncture of the tab and facepiece and maintain the tabs in a spaced-apart configuration as is best shown in FIG. 2. Means 80 are preferably of generally hemispherical or dome-shape and may conveniently be formed by indenting the outer surface of tab 16. The width 20 of the tabs 16, the spacing 22 between the facepieces 12 maintained by abutting means 80, and the thickness 24 of the facepieces 12 and tabs 16 are such that both tabs 16 simultaneously enter into a predrilled hole 26 in a printed circuit board 28 as described more fully hereinafter. For a typical circuit board hole 26 having a diameter of 0.100 inch, the optimum width of tabs 16 is about 0.080 inch, with a tab thickness of about 0.010 inch and an abutting means height of about 0.020 inch to provide a tab spacing of approximately 0.040 inch. This spacing is sufficient to allow the arms of an automatic clinching machine to be inserted between the tabs.

Four parallel C-shaped channels 30 are connected one to each lateral edge 32, in a symmetrical arrangement to the facepieces 12. The concave surfaces of the C-channels 30 face the facepieces 12. The C-shaped channels 30 on one facepiece 12 extend from the edge 32 of attachment in the direction away from the other facepiece 12 and than turn inwardly towards each other and loop back toward the planar surface of the facepiece 12 (FIG. 2) leaving a small opening 34 between the end 36 of the C-channels 30 and the facepiece 12. The other facepiece 12 and C-channels 30 are similarly connected and the description above applies equally to both facepieces 12.

Flat strip flanges 38 extend from the unattached ends 36 of the C-channels 30. The strip flanges 38, where attached to the C-channels 30 may be generally parallel to the plane of the facepieces 12 or may diverge from the facepieces at a small angle. In either parallel or divergent attitude, the opening space 34 between facepieces 12 and ends 36 of the C-channels is maintained. In the embodiment wherein flanges 38 diverge from the facepieces, contact forces exerted on the prongs of spade connector 50 tend to be concentrated along the juncture 36 of the flanges to make for a better electrical connection.

Figure 5:
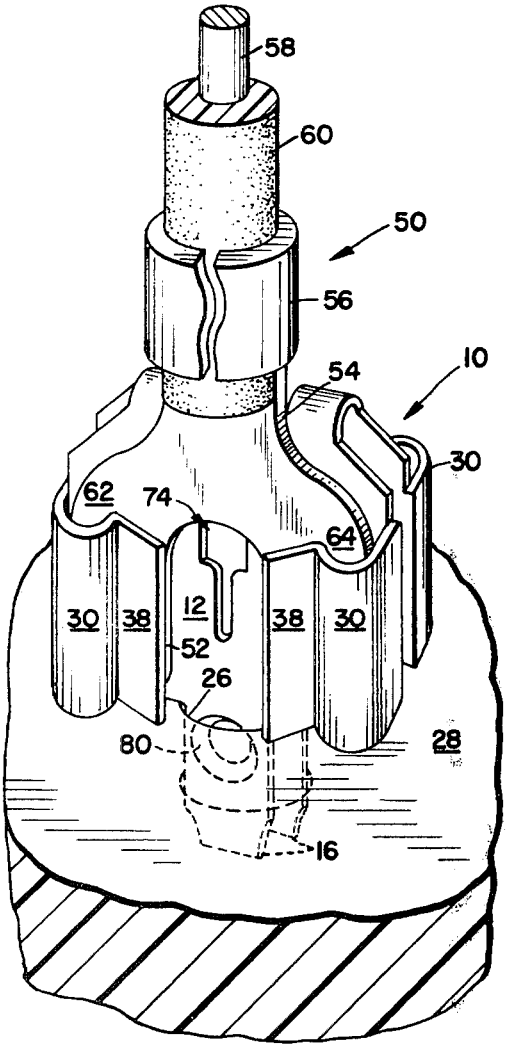
FIG. 5 is a perspective view showing the spade connector of FIG. 4 inserted in the terminal of FIG. 1.

The lower edges 40 of the C-channels 30 and strip flanges 38 are coextensive with the lower edges 18 of the facepieces 12 such that these edges 18, 40 lie in a common planar surface. Where the terminal 10 is mounted on a printed circuit board 28 with the central tabs 16 fully inserted through a hole 26, the lower facepiece edges 18 and lower C-channel and strip flange edges 40 rest upon the upper surface of the circuit board 28 (FIGS. 3, 5). The combination of a single facepiece 12 with two connected C-channels 30 and strip flanges 38 forms a single receptacle for receiving a spade connector 50. Accordingly, each spade terminal 10 includes two back-to-back receptacles mechanically interconnected by the webs 14.

Each facepiece 12 has a slot 74 passing therethrough. The slot 74 is a generally square shape opening 75 having an elongated narrow channel 76 extending toward the tab 16. The channel width 78 is suited to receive a solid conductor wire. The wire (not shown) is inserted through the opening 75 and then the solid conductor is forced into the channel 76.

The spade terminal 10 is fabricated of a resilient, electrically conductive material such that the strip flanges 38 are resiliently spaced away from the facepieces 12. When the flanges 38 are further displaced away from the facepieces 12, elastic spring action of the C-channels 30 applies a force which tends to return the strip flanges 38 to an equilibrium undisplaced condition.

To enhance the conductivity of the terminal 10, platings (not shown) are applied to the surfaces. For example, brass alloy 260, Grade A, ½ hard, 0.010 inch thick has been used satisfactorily with a tin-lead or tin plating over a plating of copper. Platings in a thickness range as little as 0.0001 to 0.0005 inch are suitable. The plating provides improved shelf life, solderability and a better product appearance. The entire terminal 10 is a single piece of metal, stamped and formed to the desired configuration. Plating may be done either before or after stamping according to customer specification. With pre-plated stock, conductor material is present on the contact surfaces after stamping.

Figure 4:
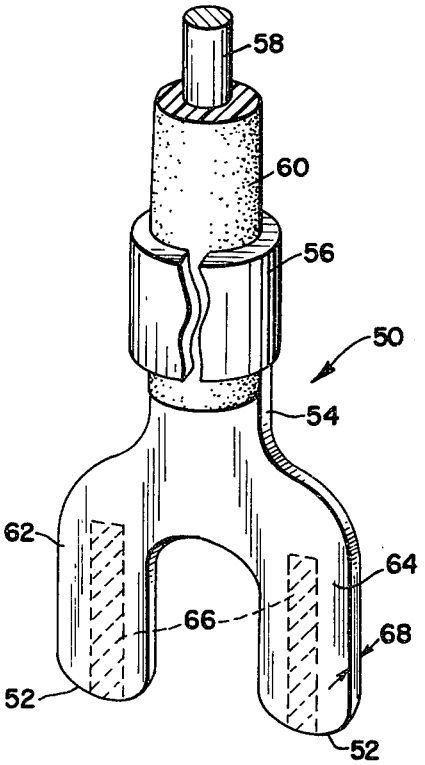
FIG. 4 is a perspective view to an enlarged scale of a spade connector.

FIG. 4 illustrates a spade connector 50 suitable for use with the spade terminal 10 of this invention. The spade connector 50 is comprised of a pair of flat electrically conductive prongs 52 spaced apart and extending from a common shank 54. Grippers 56 extend generally circularly from the shank 54 and receive therebetween a conventional conductor 58 surrounded by insulation 60. The grippers 56 are crimped to hold the insulated conductor 58, 60 to the connector 50 and the conductor 58 is connected (not shown) electrically to the prongs 52. Spade connectors 50 of this general type are well known, are not a novel part of this invention and accordingly warrant no more particularly detailed description here.

In use of the spade terminal 10, the spade connector 50 is inserted in a receptacle of the terminal 10, with one strip flange 38 pressing against one surface 62 of one prong 52 and the other strip flange 38 pressing against the similar surface 64 of the other prong 52. The reverse surfaces of the prongs 52 rest against the facepiece 12. The contact 'footprints' of the strip flanges 38 on the prongs 52 are indicated in FIG. 4 by the shaded areas 66. The prong thickness 68 exceeds the spacing 34 between the strip flanges 38 and facepiece 12, such that the C-shaped channels 30 are flexed away from the facepiece 12 as the prongs 52 are pressed slidingly into the receptacle. Accordingly, the strip flanges 38 exert a compressive force on the prongs 52 which assures good electrical contact between connector 50 and terminal 10. The flat surfaces of the strip flanges 38 sliding on the prong surfaces 62, 64 distribute the stresses thereby reducing wear on both surfaces. Repeated insertions and withdrawals of the connector 50 are possible without penetration of the surface platings and exposure of the base material.

Figure 6:
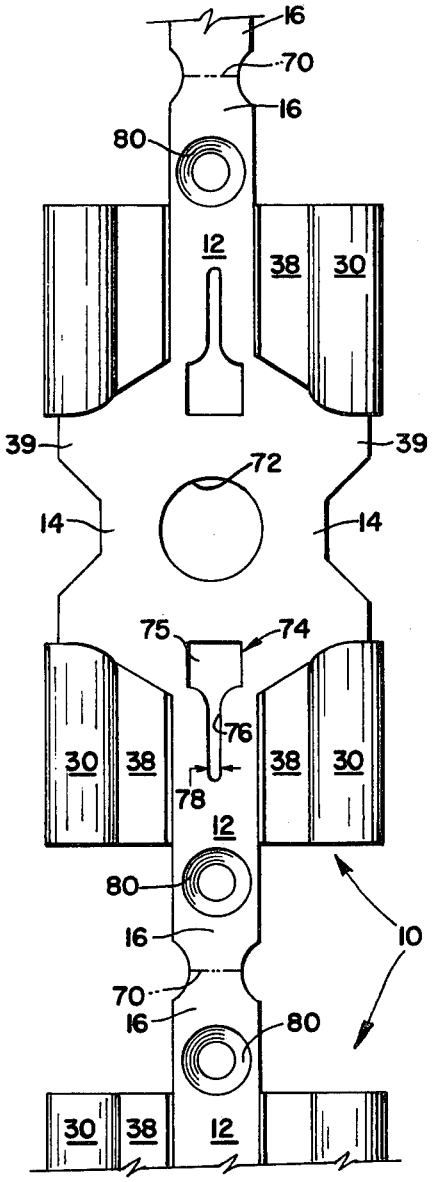
FIG. 6 shows a connected strip of partially formed terminals.

Although amenable to hand insertion, the terminals 10 of this invention are expressly designed for use with automatic insertion machinery. To this end, the terminals are provided in strip form as is illustrated in FIG. 6. The terminals are stamped from an extended continuous sheet of conductive metal such as brass alloy and are formed to define the C-shaped channels 30 and strip flanges 38. Tab portions 16 are indented to form on the opposite surface hemispherical or dome-shaped abutting means 80. On the strip the facepieces 12, webs 14 and central tabs 16 are coplanar and these generally flattened terminals 10 extend longitudinally along the strip length with the tabs 16 connected end to end at the lower edges 70. Thus, the entire strip and each terminal 10 is made from one piece of material without need for assembly operations.

In an automatic insertion machine (not shown), the tabs 16 are severed transversely along lines 70 and the separated terminal 10 is bent into the U-shape generally illustrated in FIGS. 1, 2, 3 and 5. The hole 72 between the webs 14 is useful in transporting the strip both for automated stamping and forming operations and also in the bending and insertion head of the insertion machine.

Figure 7:
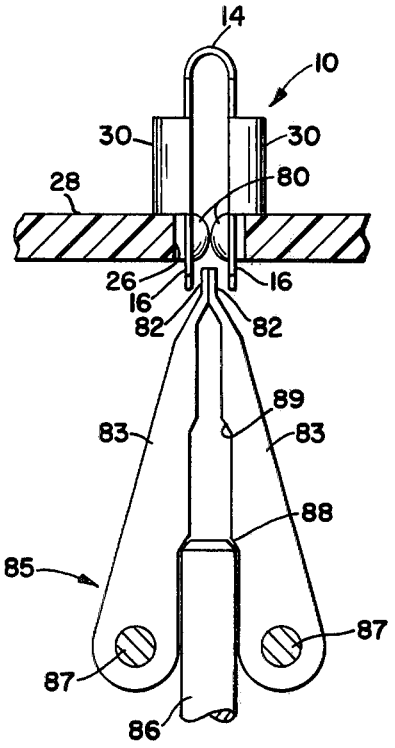
FIG. 7 is a partial sectional view showing the interaction of the terminal tabs with a clinching device.
Figure 8:
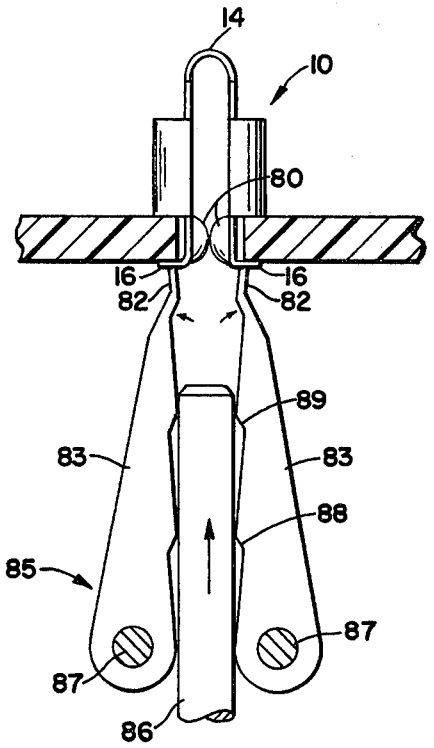
FIG. 8 illustrates the fully clinched terminal.

Referring now to FIGS. 7 and 8, tabs 16 of terminal 10 upon mounting on circuit board 28 extend through hole 26 in the circuit board and are maintained in a spaced-apart relationship by abutting means 80. The space between tabs 16 is sufficient to allow entry of fingers 82 which form the terminus of clinching arms 83 of clinching device 85. Device 85 includes an actuating rod 86 adapted to be reciprocated upwardly with respect to arms 83 from an initial or rest position generally illustrated in FIG. 7 into an actuating position generally illustrated in FIG. 8.

Clinching arms 83 are mounted adjacent the lower ends thereof upon pivot shafts 87 and include camming surfaces 88 and 89 on their inner faces. Upon movement of actuating rod 86 with respect to the clinching arms in the manner illustrated in FIGS. 7 and 8, fingers 82 are caused to be simultaneously pivoted apart so as to progressively bend tabs 16 to a position substantially parallel to the under surface of circuit board 28 and thereby positively clinching the tabs into engagement with the circuit board.

As may be appreciated from the above description, abutting members 80 most advantageously are positioned on tabs 16 so that they are centered within the circuit board upon assembly. After terminals 10 have been inserted on and clinched to a circuit board, the board may be subjected to multiple component insertion and transport operations prior to soldering without displacement of the terminals.

I claim:

1. Partially formed, electrically conductive terminals in unitary strip form adapted for automatic insertion on and clinching to a circuit board, each of said terminals comprising;

a pair of coplanar facepieces;

a web, said web connecting said facepieces together at one end;

four parallel resilient C-shaped channels, one edge of each of said C-shaped channels connected to a lateral edge of each of said facepieces, said channels extended a distance from said lateral edges of connection in a direction away from said facepieces and turned around parallel to said facepiece and further turned toward said facepieces thereby forming said C-shaped channels, the concave surfaces of said C-shaped channels facing said facepieces, the other unattached edges of said C-shaped channels being spaced apart a distance from said facepieces;

a pair of coplanar tabs, each one of said tabs extending from the other end of each one of said facepieces along the longitudinal axis of said unitary strip;

a pair of abutting means, one on each tab adjacent the juncture of the tab and facepiece, said abutting means comprising a generally hemispherical dome on one tab surface formed by indenting the opposite tab surface, the diameter of said dome being essentially no greater than the thickness of said circuit board, said abutting means positioned on said tab so as to be essentially centered within said circuit board upon insertion thereon;

said unitary strip being formed by an interconnection of one of said coplanar tabs of one terminal with one of said coplanar tabs of an adjacent terminal.

2. A one-piece terminal of electrically conductive material having first and second receptacles for receiving the prongs of spade connectors therein and especially adapted for automated insertion on and clinching to a printed circuit board, comprising;

a pair of opposed, planar and parallel facepieces each of said facepieces including a slot therethrough;

a web, said web connecting said facepieces together at one end;

a pair of parallel tabs, each one of said tabs coplanar with and extending from the other end of each one of said facepieces;

a pair of inwardly extending abutting means, one on each tab adjacent the juncture of the tab and facepiece, said abutting means adapted to hold said tabs spaced apart a distance substantially equal to the width of said web, said abutting means being generally hemispherical in shape and having a diameter essentially no greater than the thickness of said circuit board, said means positioned on said tab so as to be essentially centered within said circuit board upon insertion thereon;

four parallel resilient C-shaped channels, one edge of each of said C-shaped channels connected to a lateral edge of each of said facepieces, said channels extended a distance from said lateral edges of connection in a direction away from said facepieces and turned around parallel to said facepiece and further turned toward said facepieces thereby forming said C-shaped channels, the concave surfaces of said C-shaped channels facing said facepieces, the other unattached edges of said C-shaped channels being spaced apart a distance from said facepieces; and four flat strip flanges, one strip flange extending from each of said unattached edges of said C-shaped channels thereby forming a pair of C-shaped channels with strip flanges on each facepiece, each pair of strip flanges being dimensioned such that access to said slot in said facepiece is not blocked thereby.

* * * * *